US006988967B2

(12) United States Patent
Allison

(10) Patent No.: US 6,988,967 B2
(45) Date of Patent: Jan. 24, 2006

(54) TEAM TRAMPOLINE GAME AND METHOD OF PLAYING THE SAME

(76) Inventor: Danny Brian Allison, #2 Haro Place, St. Albert, Alberta (CA) T8N 6V2

( * ) Notice: Subject to any disclaimer, the term of this patent is extended or adjusted under 35 U.S.C. 154(b) by 95 days.

(21) Appl. No.: 10/656,461

(22) Filed: Sep. 5, 2003

(65) Prior Publication Data

US 2004/0053712 A1 Mar. 18, 2004

(30) Foreign Application Priority Data

Sep. 19, 2002 (CA) ..... 2400248

(51) Int. Cl.
*A63B 67/00* (2006.01)

(52) U.S. Cl. ..... 473/473; 473/469

(58) Field of Classification Search ..... 473/469, 473/490, 415, 477, 472, 473; 273/393; 482/27–29; D21/797

See application file for complete search history.

(56) References Cited

U.S. PATENT DOCUMENTS 3,233,895 A * 2/1966 Grelle et al. ..... 482/27
3,312,471 A * 4/1967 Nissen ..... 473/469
4,433,838 A * 2/1984 Gordon ..... 473/473
4,569,515 A * 2/1986 Gordon ..... 473/473
5,624,122 A * 4/1997 Winkelhorn ..... 473/471
5,833,557 A * 11/1998 Cole ..... 473/472
6,634,966 B2 * 10/2003 Gordon ..... 473/415
6,682,444 B2 * 1/2004 Gordon ..... 473/415

OTHER PUBLICATIONS

Gordon's Aeroball Website materials (3 pages) , printed off website www.aeroballanyone.com, Jul. 7, 2003.
News Release 1, News Release 2 and News Release 3, (3 pages) printed off website www.aeroballanyone.com, Jul. 7, 2003.

* cited by examiner

*Primary Examiner*—Stephen Blau
*Assistant Examiner*—M. Chambers
(74) *Attorney, Agent, or Firm*—Davis & Bujold, P.L.L.C.

(57) ABSTRACT

A team trampoline game includes an elongate rectangular enclosure having parallel side walls, a first end wall and a second end wall. A first team goal is positioned on the first end wall which is adapted to permit a game projectile to pass through. A second team goal is positioned on the second end wall which is adapted to permit the game projectile to pass through. A first team offensive trampoline is spaced from the second team goal. A second team defensive trampoline is positioned between the first team offensive trampoline and the second team goal. A second team offensive trampoline is spaced from the first team goal. A first team defensive trampoline is positioned between the second team offensive trampoline and the first team goal. Protective barriers are positioned between the trampolines to prevent collisions between players.

4 Claims, 5 Drawing Sheets

TEAM TRAMPOLINE GAME AND METHOD OF PLAYING THE SAME

FIELD OF THE INVENTION

The present invention relates to a game to be played by teams of players while bouncing on trampolines and rules for playing the same.

BACKGROUND OF THE INVENTION

U.S. Pat. No. 5,833,557 (Cole 1998) discloses a basketball game played by individual players while bouncing on a trampoline. A frame is placed over the surface of the trampoline which divides the trampoline into two symmetrical and adjacent playing areas. Two basketball goals are provided facing each other on opposed ends of the trampoline. The frame is raised sufficiently to allow a basketball to pass underneath. Although separate and mechanically isolated trampolines may be used for each playing area, it is preferred that a single continuous trampoline be shared by the two playing areas. This allows an additional strategic element to be added to the game in which a player uses the timing of his or her own jump to change the rebound characteristics of the trampoline.

SUMMARY OF THE INVENTION

The present invention relates to a team trampoline game.

According to one aspect of the present invention there is provided a trampoline game which includes an elongate rectangular enclosure having parallel side walls, a first end wall and a second end wall. A first team goal is positioned on the first end wall which is adapted to permit a game projectile to pass through. A second team goal is positioned on the second end wall which is adapted to permit the game projectile to pass through. A first team offensive trampoline is spaced from the second team goal. A second team defensive trampoline is positioned between the first team offensive trampoline and the second team goal. A second team offensive trampoline is spaced from the first team goal. A first team defensive trampoline is positioned between the second team offensive trampoline and the first team goal. A first protective barrier between the first team offensive trampoline and the second team defensive trampoline, the first protective barrier being adapted to prevent collisions between players. A second protective barrier is positioned between the second team offensive trampoline and the first team defensive trampoline, the second protective barrier being adapted to prevent collisions between players. A third protective barrier is positioned between the first team offensive trampoline and the second team offensive trampoline, the third protective barrier being adapted to prevent collisions between players.

According to another aspect of the present invention there is provided a method of playing a trampoline game. A first step involves providing a trampoline game structure, substantially as described above. A second step involves playing by having a defensive player bouncing on either the first team defensive trampoline or the second team defensive trampoline pass the game projectile to his offensive player team-mate bouncing on the respective offensive trampoline. The offensive player then attempts to score by propelling the game projectile past the other team's defensive player and into the other team's goal.

The trampoline game and method of play described above, is a team game which requires co-ordination and passing.

Although beneficial results may be obtained through the use of the trampoline game, as described above, after experimenting with various types of goals it was determined that even more beneficial results may be obtained when the first team goal has an opening positioned substantially parallel to the first end wall and the second team goal has an opening positioned substantially parallel to the second end wall. This configuration of goal is best suited for the game structure and also allows more flexibility as to the type of game projectiles which can be used. One could use various types of balls, such as a volleyball or water polo ball. These balls could be manually propelled in accordance with rules of volleyball or water polo. One could also turn this into a team racquet game and use game projectiles from one of several racquet sports and propel them with racquets.

Although beneficial results may be obtained through the use of the trampoline game, as described above, it is convenient to return the game projectile to play as soon as possible so as not to disrupt the flow of the game. Even more beneficial results may, therefore, be obtained when each team goal has a receptacle with an inlet opening and an outlet opening. The receptacle preferably has a bottom that is sloped downwardly toward the outlet opening, such that a game projectile positioned within the receptacle tends to slide down the bottom to the outlet opening.

Although beneficial results may be obtained through the use of the trampoline game, as described above, in testing of a prototype of the game structure problems were encountered with keeping players confined on their respective trampolines. In normal trampoline use, persons tend to centrally position themselves while bouncing on a trampoline. However, with the present game, players ignore their positioning on the trampoline while pursuing the game projectile (usually some sort of ball). In order to ensure the safety of the players, even more beneficial results may be obtained when each of the trampolines is suspended by springs, and a bottom edge of each of the side walls is lashed onto a peripheral edge of each of the trampolines, such that the springs are positioned outside of the side walls. This prevents a player's leg from passing between a peripheral edge of one the trampolines and one of the side walls.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
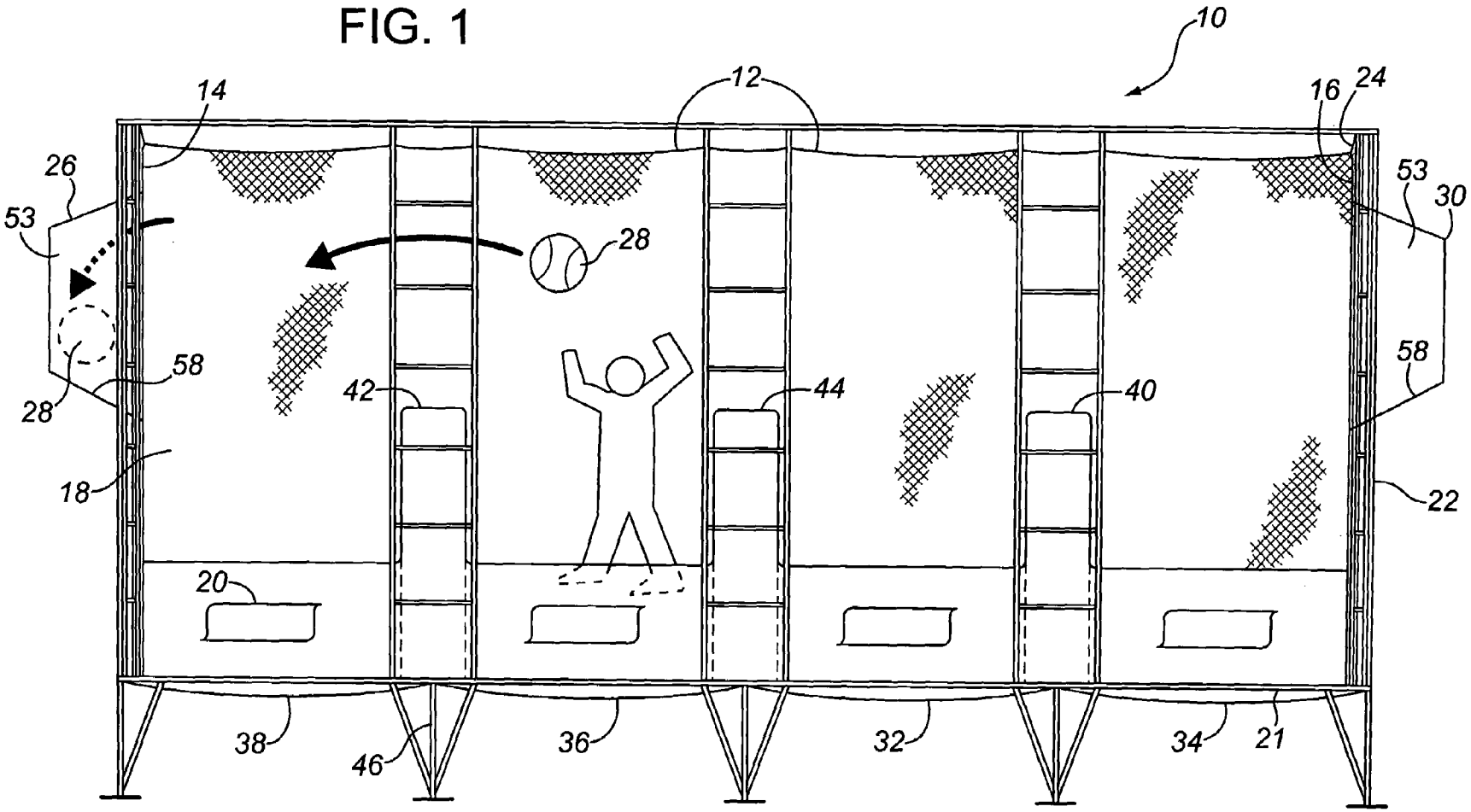
FIG. 1 is a side elevation view of the trampoline game depicting both the outer and inner components of the game.

The preferred embodiment, a trampoline game generally identified by reference numeral 10, will now be described with reference to FIGS. 1 through 6.

Structure and Relationship of Parts:

Referring to FIG. 1, there is illustrated a trampoline game generally indicated by reference numeral 10. Trampoline game 10 includes an elongate rectangular enclosure 12 having a first end wall 14, a second end wall 16 and side walls 18 which are adapted in part with see-through netting. Side walls 18 include entrance flaps 20. Enclosure 12 is suspended and supported by an outer frame 22 and supports 24. A first team goal 26 is positioned on first end wall 14 and is adapted to permit a game projectile 28 to pass through. A second team goal 30 is similarly positioned on second end wall 16 and similarly adapted to permit game projectile 28 to pass through.

Figure 3:
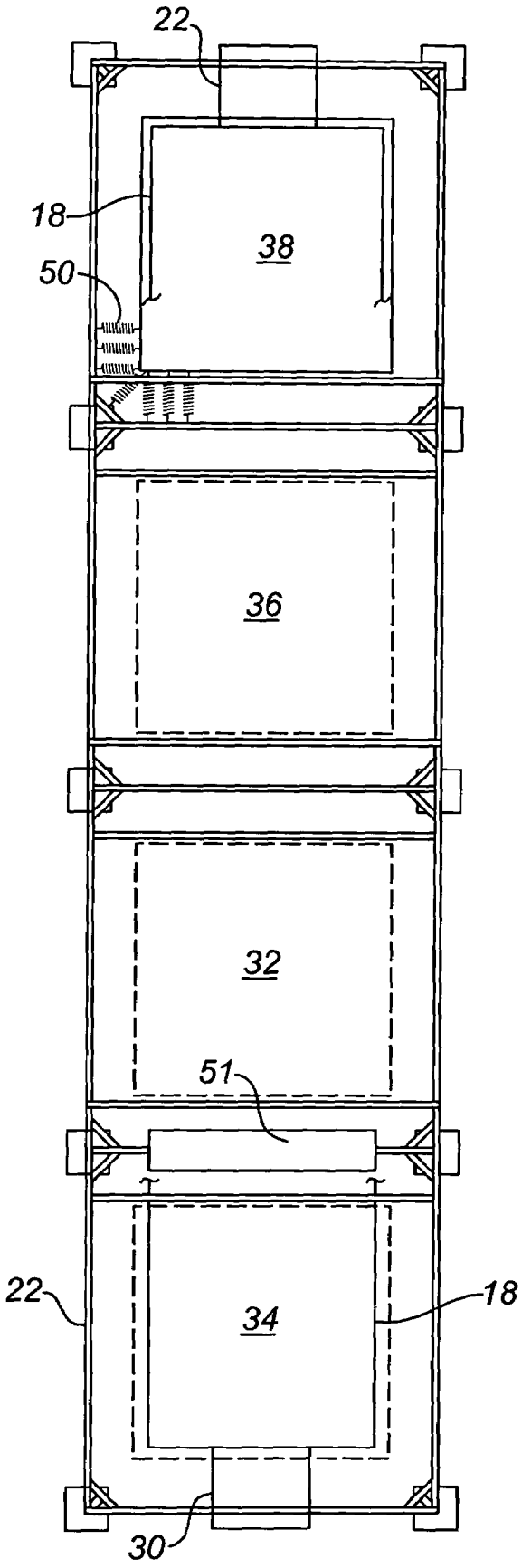
FIG. 3 is a top view of the trampoline game depicting mainly the outer frame with trampoline detail shown at one end.

Referring to FIGS. 1 and 3, a first team offensive trampoline 32 is spaced from second team goal 30. A second team defensive trampoline 34 is positioned between first team offensive trampoline 32 and second team goal 30. A second team offensive trampoline 36 is spaced from first team goal 26. A first team defensive trampoline 38 is positioned between second team offensive trampoline 36 and first team goal 26. Referring to FIG. 1, a first protective barrier 40, adapted in part with see-through netting, is positioned between first team offensive trampoline 32 and second team defensive trampoline 34. A second protective barrier 42, adapted in part with see-through netting, is positioned between second team offensive trampoline 36 and first team defensive trampoline 38. A third protective barrier 44, adapted in part with see-through netting, is positioned between first team offensive trampoline 32 and second team offensive trampoline 36.

Figure 2:
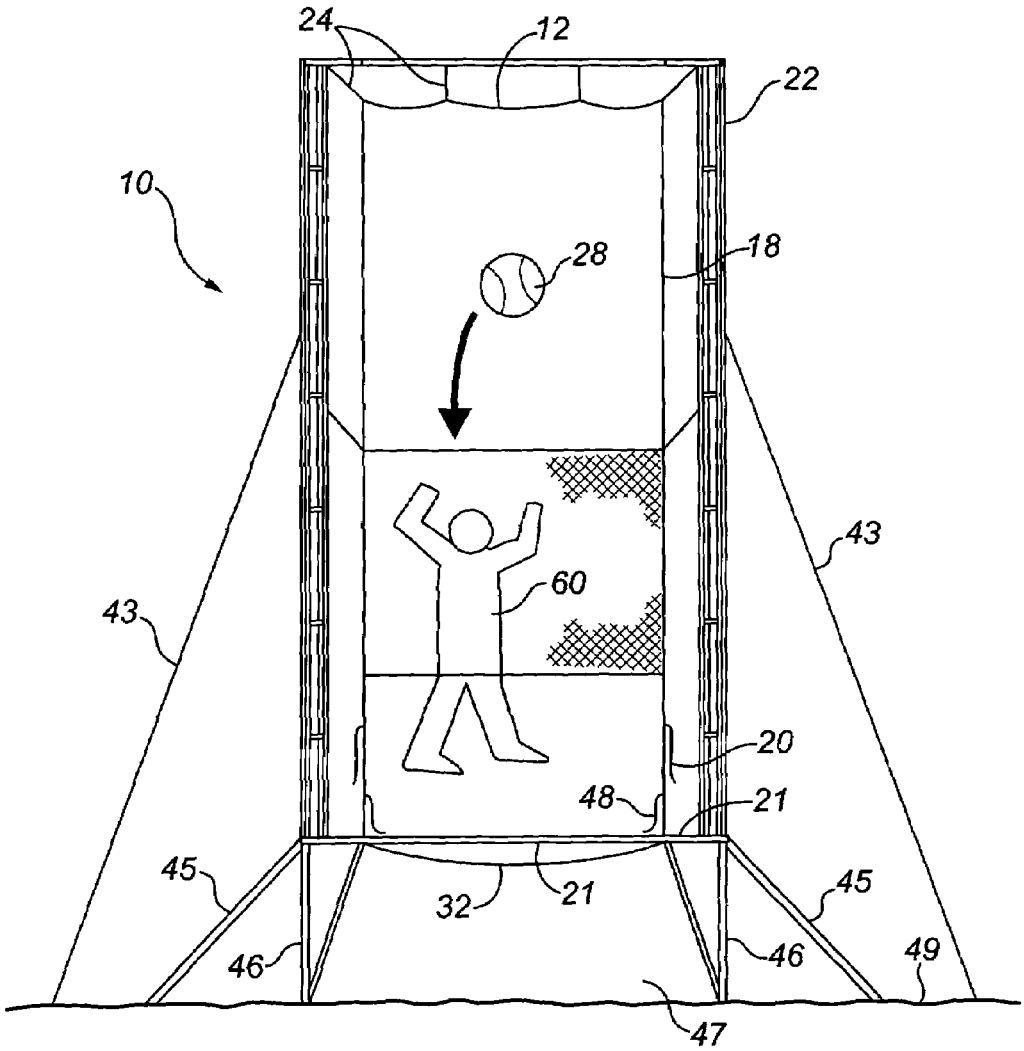
FIG. 2 is a cross section of FIG. 1.

Referring to FIG. 2, elongate enclosure 12 consists of two parallel side walls 18 supported by outer frame 22 and supports 24. Outer frame 22 is has legs 46, which provide clearance to enable the trampolines to function. Cables 43 that project outwardly from outer frame 22 or bracing members 45 that project outwardly from legs 46 can be added to stabilize outer frame 22 when it is used in heavy winds. A skirt 47 depends from base 21 of outer frame 22 to underlying surface 49 to prevent access beneath enclosure 12. Where side walls 18 meet each of first team offensive trampoline 32, second team defensive trampoline 34, second team offensive trampoline 36 and first team defensive trampoline 38 at base 21 of outer frame 22, a protective flap 48 is provided thereby facilitating safety.

Figure 4:
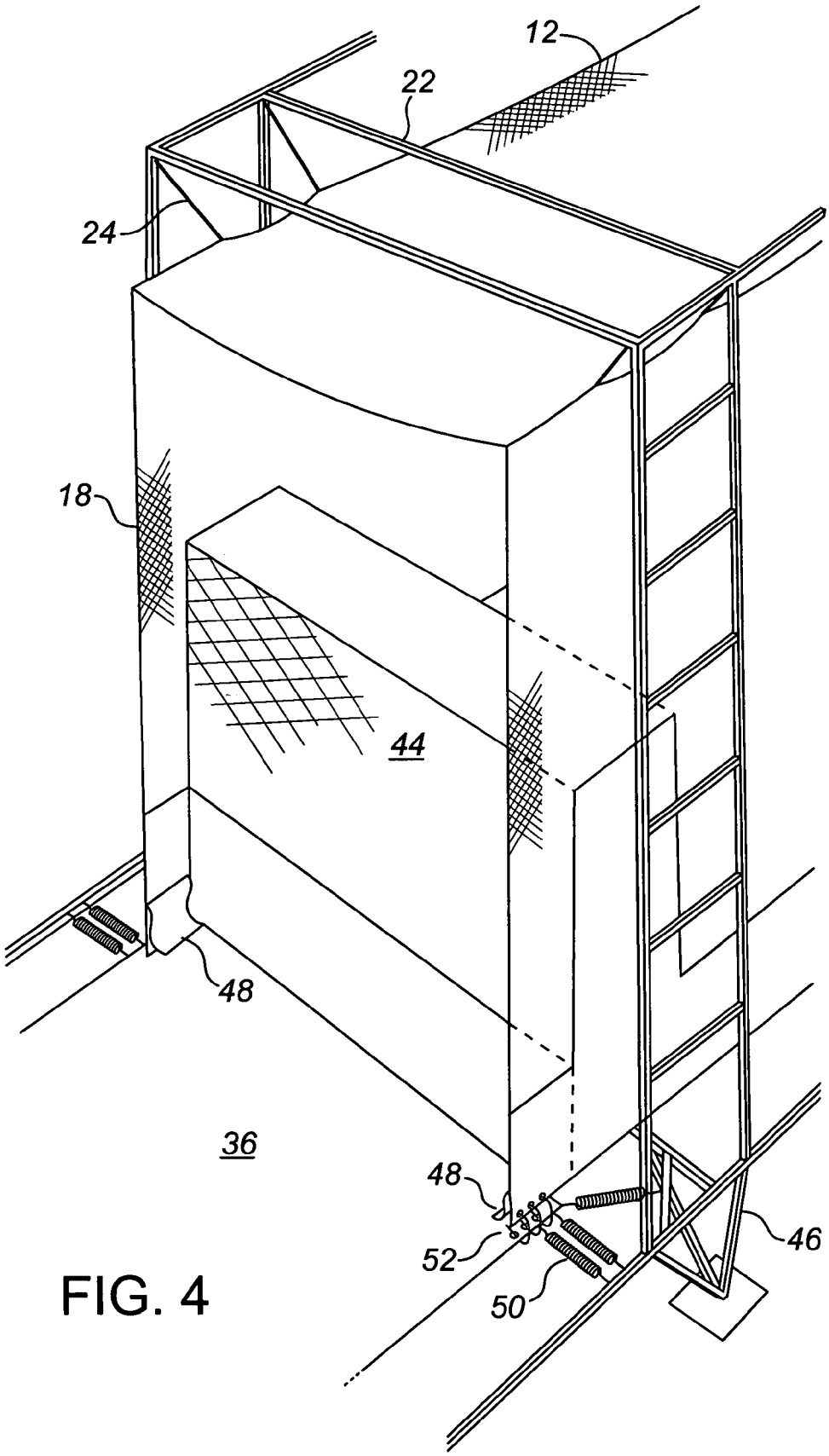
FIG. 4 is a perspective view of a cross section depicting the placement of protective barriers relative to the rest of the structure.

Referring to FIGS. 3 and 4, each of trampolines 32, 34, 36 and 38 are suspended by springs 50. Referring to FIG. 4, bottom edge 45 of each of side walls 18 is lashed with lashing 52 onto a peripheral edge 47 of each of trampolines 32, 34, 36 and 38. Springs 50 are positioned outside of side walls 18. Referring to FIG. 3, pads 51 are secured over springs 50 between each of trampolines 32, 34, 36 and 38, and side walls 18 to preventing a player's leg from passing between one of trampolines 32, 34, 36 and 38, and one of side walls 18. Referring to FIG. 4, safety is further advanced by having protective flap 48 positioned over lashing 52.

Figure 5:
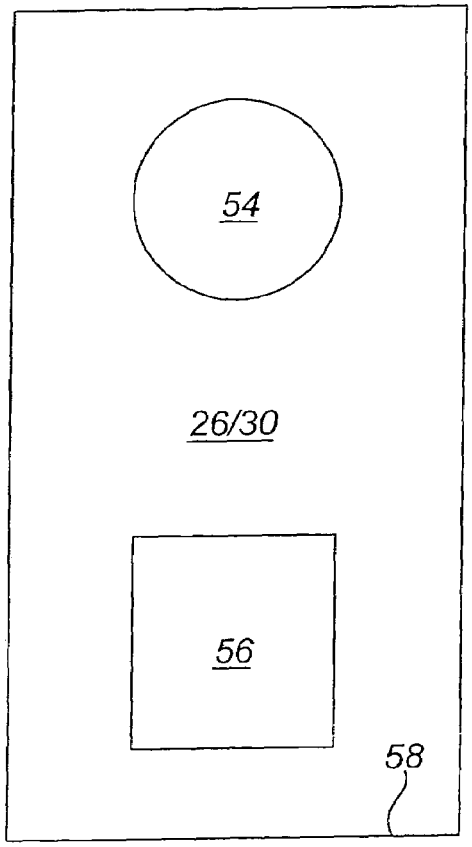
FIG. 5 is a front elevation view of a goal illustrated in FIG. 1.
Figure 6:
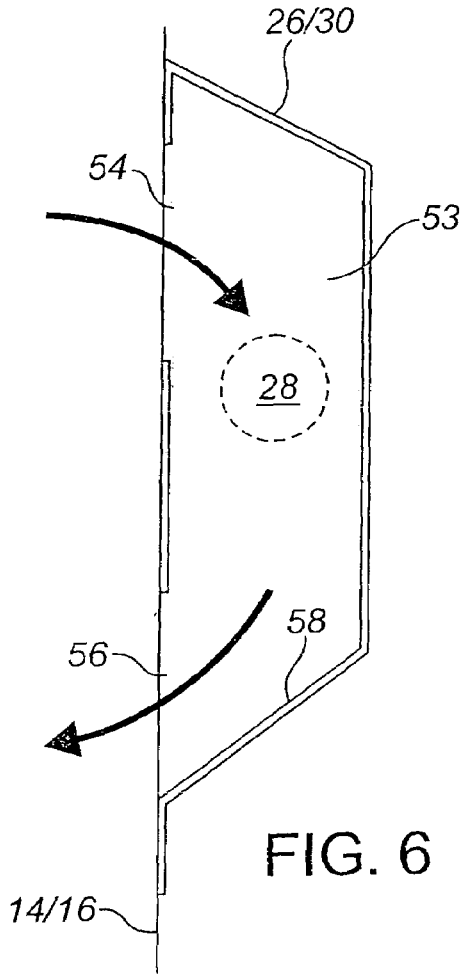
FIG. 6 is a side elevation view of the goal illustrated in FIG. 5.

Referring to FIGS. 5 and 6, first team goal 26 is in the nature of a receptacle 53 having an inlet opening 54 and an outlet opening 56. Inlet opening 54 is positioned substantially parallel to first end wall 14 illustrated in FIG. 1, with receptacle 53 having a bottom 58 that is sloped downwardly toward outlet opening 56. As a result, game projectile 28 when positioned within receptacle 53, tends to slide down bottom 58 to outlet opening 56. Second team goal 30, which is similar in nature, includes a receptacle 53 having an inlet opening 54 and an outlet opening 56. Inlet opening 54 is similarly positioned substantially parallel to second end wall 16 illustrated in FIG. 1, with receptacle 53 having a bottom 58 that is sloped downwardly toward outlet opening 54. Referring to FIG. 6, as a result, game projectile 28 when positioned within receptacle 53, tends to slide down bottom 58 to outlet opening 54.

Operation:

The use and operation of trampoline game 10 in accordance with the preferred method of play will now be described with reference to FIGS. 1 through 6.

Referring to FIG. 1, four players 60, entering through entrance flaps 20, occupy one each of trampolines 32, 34, 36 and 38. Although only one player 60 is illustrated in FIG. 1, it will be appreciated that four players 60 are included in playing game 10. Players 60 on trampolines 32 and 38 which constitute a first team, attempt to advance game projectile 28 into second team goal 30; and players 60 of trampolines 34 and 36 which constitute a second team, attempt to advance same game projectile 28 into first team goal 26. A key to success in game 10 is bouncing so as to position oneself advantageously. Safety is advanced by use of first protective barrier 40, second protective barrier 42 and third protective barrier 44 and protection flap 48 as cited above Referring to FIG. 1, game projectile 28 moves from space to space within elongate enclosure 12 and over first protective barrier 40, second protective barrier 42 and third protective barrier 44. Referring to FIG. 6, eventually, game projectile 28 will be directed through inlet opening 54 of one or other of first team goal 26 or second team goal 30. The team with the highest number of goals wins.

Referring to FIG. 1, in the illustrated embodiment, game projectile 28 is illustrated as being a ball which could be a volleyball, waterball or other suitable type of ball. Furthermore, while the illustrated embodiment shows game projectile 28 being propelled manually, rackets, paddles, or scoops, could also be used to volley game projectile 28 during play.

Referring to FIG. 1, as first team goal 26 and second team goal 30, each have receptacle 53 with bottom 58 that is sloped downwardly toward outlet opening 56 illustrated in FIG. 6, game projectile 28 positioned within receptacle 53 tends to slide down bottom 58 to outlet opening 56 illustrated in FIG. 6, so as to return game projectile 28 to play as soon as possible so as not to disrupt the flow of game 10.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A trampoline game, comprising:

an elongate rectangular enclosure having parallel side walls, a first end wall and a second end wall;

a first team goal on the first end wall adapted to permit a game projectile to pass through;

a second team goal on the second end wall adapted to permit the game projectile to pass through;

a first team offensive trampoline spaced from the second team goal;

a second team defensive trampoline positioned between the first team offensive trampoline and the second team goal;

a second team offensive trampoline spaced from the first team goal;

a first team defensive trampoline positioned between the second team offensive trampoline and the first team goal;

a first vertical protective barrier between the first team offensive trampoline and the second team defensive trampoline;

a second vertical protective barrier between the second team offensive trampoline and the first team defensive trampoline;

a third vertical protective barrier between the first team offensive trampoline and the second team offensive trampoline, and each of the trampolines being suspended by springs, and a bottom edge of each of the side walls being lashed onto a peripheral edge of the each of the trampolines, such that the springs are positioned outside the sidewall and overlying pads prevent a pleyer's legs from passing between one of the trampolines and one of the side walls.

2. The trampoline game as defined in claim 1, wherein the first team goal has an opening positioned substantially parallel to the first end wall and the second team goal has an opening positioned substantially parallel to the second end wall.

3. The trampoline game as defined in claim 1, wherein each of the first team goal and the second team goal has a receptacle having an inlet opening and an outlet opening, the receptacle having a bottom that is sloped downwardly toward the outlet opening, such that a game projectile positioned within the receptacle tends to slide down the bottom to the outlet opening.

4. A trampoline game, comprising:

an elongate rectangular enclosure having parallel side walls, a first end wall and a second end wall;

a first team goal on the first end wall adapted to permit a game projectile to pass through, the first team goal being a receptacle having an inlet opening and an outlet opening, the inlet opening being positioned substantially parallel to the first end wall, the receptacle having a bottom that is sloped downwardly toward the outlet opening, such that a game projectile positioned within the receptacle tends to slide down the bottom to the outlet opening;

a second team goal on the second end wall adapted to permit the game projectile to pass through, the second team goal being a receptacle having an inlet opening and an outlet opening, the inlet opening being positioned substantially parallel to the first end wall, the receptacle having a bottom that is sloped downwardly toward the outlet opening, such that a game projectile positioned within the receptacle tends to slide down the bottom to the outlet opening;

a first team offensive trampoline spaced from the second team goal;

a second team defensive trampoline positioned between the first team offensive trampoline and the second team goal;

a second team offensive trampoline spaced from the first team goal;

a first team defensive trampoline positioned between the second team offensive trampoline and the first team goal;

a first vertical protective barrier between the first team offensive trampoline and the second team defensive trampoline;

a second vertical protective barrier between the second team offensive trampoline and the first team defensive trampoline;

a third vertical protective barrier between the first team offensive trampoline and the second team offensive trampoline, each of the trampolines being suspended by springs, and a bottom edge of each of the side walls being lashed onto a peripheral edge of each of the trampolines, such that the springs are positioned outside of the side walls and overlying pads prevent a player's leg from passing between one the trampolines and one of the side walls.

* * * * *